US005546906A

United States Patent [19]

Cooke

[11] Patent Number: 5,546,906

[45] Date of Patent: Aug. 20, 1996

[54] FUEL INJECTION PUMP

[75] Inventor: Michael P. Cooke, Gillingham, United Kingdom

[73] Assignee: Lucas Industries, Solihull, England

[21] Appl. No.: 522,484

[22] Filed: Aug. 31, 1995

[30] Foreign Application Priority Data

Oct. 7, 1994 [GB] United Kingdom ..... 9420254

[51] Int. Cl.[6] ..... F02M 37/04

[52] U.S. Cl. ..... 123/447; 123/450; 123/506

[58] Field of Search ..... 123/450, 506, 123/447, 41.31; 417/462; 137/568

[56] References Cited

U.S. PATENT DOCUMENTS

| | | | |
|---|---|---|---|
| 4,313,464 | 2/1982 | Major | 137/568 |
| 5,027,776 | 7/1991 | Nicol | 123/450 |
| 5,035,587 | 7/1991 | Collingborn et al. | 123/450 |
| 5,203,303 | 4/1993 | Collingborn et al. | 123/450 |
| 5,207,202 | 5/1993 | Collingborn | 123/450 |
| 5,213,481 | 5/1993 | Stringfellow et al. | 123/450 |
| 5,413,081 | 5/1991 | Collingborn | 123/450 |

*Primary Examiner*—Thomas N. Moulis
*Attorney, Agent, or Firm*—Robbins, Berliner & Carson

[57] ABSTRACT

A fuel injection pump of the kind including a pumping plunger movable inwardly in a bore to displace fuel to an outlet. A spill valve member coupled to a piston slidable in a cylinder is moved to the open position to spill fuel from the bore when a control valve is opened to supply a pulse of fuel under pressure to one end of the cylinder. The fuel spilled from the bore also flows into the one end of the cylinder. A restricted flow path is provided to allow fuel to escape from said one end of the cylinder and a further restricted flow path may be provided to allow fuel from a low pressure source to flow into said one end of the cylinder.

4 Claims, 1 Drawing Sheet

FUEL INJECTION PUMP

This invention relates to a fuel injection pump for supplying fuel to an internal combustion engine and of the kind comprising a pumping plunger slidable in a bore, a cam operable to move the pumping plunger inwardly towards one end of the bore, an outlet extending from said end of the bore and through which fuel is supplied to the associated engine, a spill valve including a spill valve member operable to spill fuel from said end of the bore during inward movement of the plunger thereby to control the quantity of fuel supplied through said outlet, means biasing the valve member to the closed position, a piston slidable in a cylinder and a control valve operable to supply fuel under pressure from said end of the bore to one end of said cylinder thereby to displace the piston towards the other end of the cylinder, said piston and said spill valve member being operatively connected so that movement of the piston away from said one end of the cylinder effects movement of the spill valve member from the closed position to spill fuel from said one end of the bore.

In the use of the pump, when the control valve is opened to allow fuel flow to the one end of the cylinder, the fuel in the bore is at high pressure and the energy in the fuel is dissipated as heat thereby heating the surrounding structure of the pump. Moreover, in one construction of the pump the fuel which flows past the spill valve flows into the one end of the cylinder and is returned to the bore prior to the next delivery of fuel. The result is that the surrounding structure of the pump can become very hot and this may lead to pump seizure. This is the case particularly when the associated engine is running under light load conditions because very little fuel is being delivered to the engine and therefore very little fresh and relatively cool fuel is being supplied to the bore.

The object of the invention is to provide a pump of the kind specified in an improved form.

According to the invention the piston and the wall of the cylinder define a restricted flow path whereby fuel can escape from said one end of the cylinder.

According to a further feature of the invention the flow path is in the form of a helical or like groove which is formed in one of the surfaces of the cylinder and piston.

An example of a fuel injection pump in accordance with the invention will now be described with reference to the accompanying drawings in which.

Figure 1:
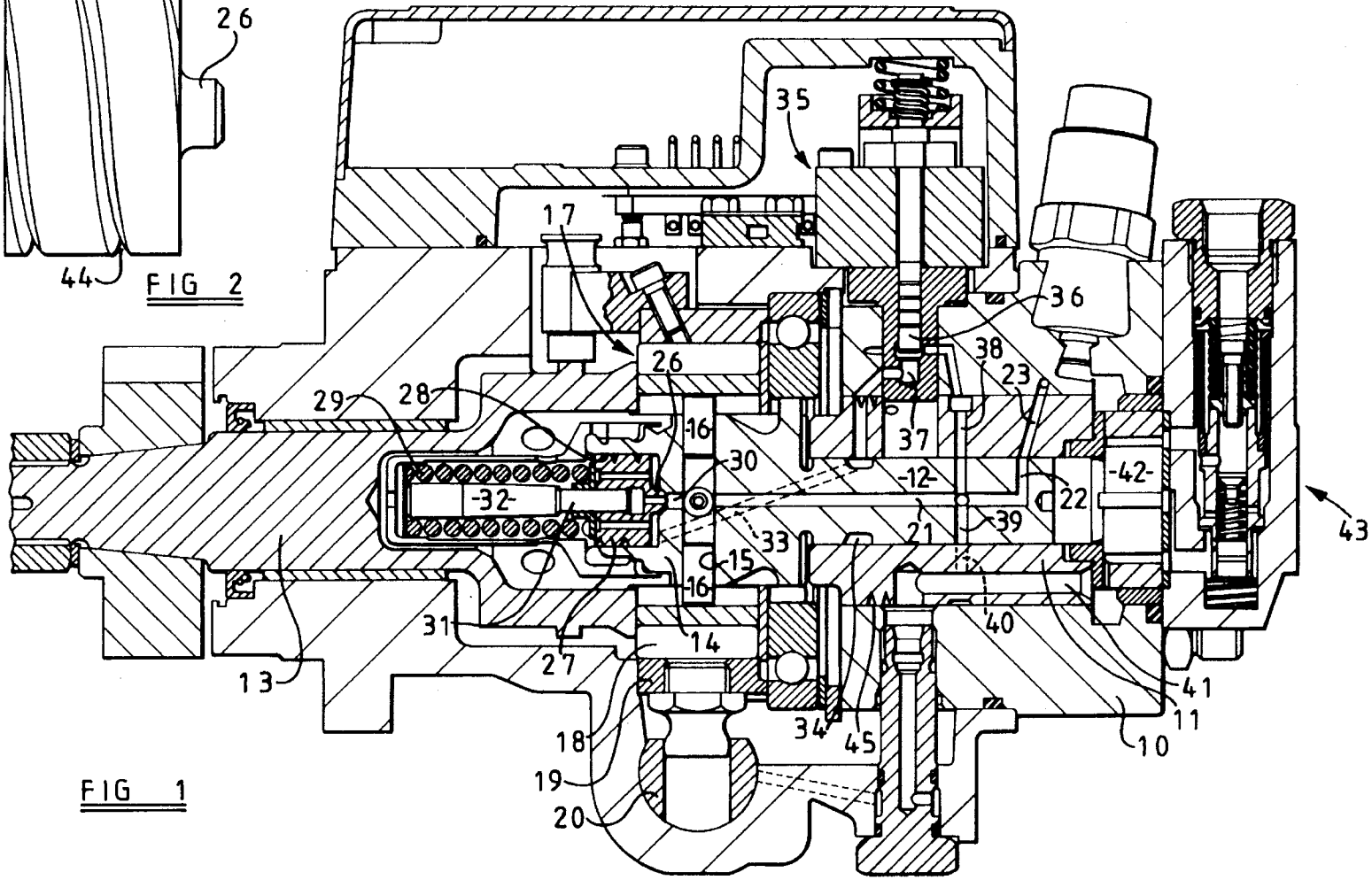
FIG. 1 shows a part sectional side elevation of the pump.

Referring to the drawings the pump comprises a multi-part body 10 in which is secured a sleeve 11 within which is mounted a rotary cylindrical distributor member 12. The distributor member extends from the sleeve and is coupled to a rotary drive shaft 13 which is journaled in the body, the drive shaft in use being coupled to a rotary part of the associated engine so that it is driven in timed relationship therewith.

The portion 14 of the distributor member which extends from the sleeve, is of enlarged diameter and has formed therein a plurality of diametrically disposed bores 15 in each of which is mounted a pair of pumping plungers 16. At their outer ends the plungers engage cam followers 17 respectively which are guided in slots formed in an annular portion of the drive shaft 13 which extends about the enlarged portion of the distributor member. Each cam follower includes a roller 18 which can engage the internal peripheral surface of an annular cam ring 19 which is mounted in the body and is movable angularly therein in known manner, by means of a fluid pressure operable piston 20.

Communicating with the bores 15 intermediate their ends, is an axially disposed passage 21 which communicates with a radially disposed delivery passage 22. The delivery passage opens onto the periphery of the distributor member and is positioned to register in turn with a plurality of outlet ports 23 only one of which is shown, the outlet ports being connected to outlets respectively mounted on the housing the outlets in use, being connected to the injection nozzles respectively of the associated engine.

Formed on the internal surface of the cam ring 19 is a plurality of cam lobes each having a leading flank and a trailing flank. As the drive shaft 13 rotates, the leading flanks of the cam lobes impart inward movement to the pumping plungers 16 and during inward movement of the pumping plungers the delivery passage 22 is in register with an outlet port 23 so that the high pressure pump constituted by the plungers and the cam lobes, delivers fuel in turn to the injection nozzles of the associated engine, during successive inward movements of the plungers.

The apparatus also includes a spill valve including a valve member 26 which is formed integrally with a piston 27 which is slidably accommodated within a cylinder 28 formed in the enlarged portion 14 of the distributor member. The piston is biased by a coiled compression spring 29 in a direction towards the closed end of the cylinder 28 so as to urge the valve member into engagement with a seating defined about a passage 30 which communicates with the bores 15. In addition, the piston defines a central blind drilling the inner end of which communicates with the passage 30 by way of a narrow passage formed in the valve member and located in the drilling is a balance plunger 31 engagable with a stop 32. The balance plunger has a diameter which is slightly larger than the seat diameter of the valve member 26.

Opening into the aforesaid end of the cylinder 28 is at least one passage 33 which communicates with a circumferential groove 34 formed on the periphery of the distributor member. The passage or passages 33 have no direct communication with the bores 15 or the passage 21.

The apparatus also includes an electromagnetically operable control valve 35 having a valve member 36 which is movable into engagement with a seating defined about a passage 37 which communicates with the groove 34. The valve member 36 when lifted from its seating connects the passage 37 with a further passage 38 which opens onto the periphery of the distributor member at a position so that it can register in turn with radially disposed passages 39 formed in the distributor member and communicating with the passage 21. The valve member 36 is coupled to an armature of an electromagnetic actuator which is associated with the control valve 35 and the armature and valve member are biased by means of a spring away from the seating.

The communication of the passage 38 with a passage 39 takes place during the inward movement of the pumping plungers. The passages 39 can also communicate in turn with a fuel supply port 40, such communication taking place when the plungers are allowed to move outwardly by the cam lobes. The passage 40 communicates with the outlet 41 of a low pressure fuel supply pump 42 the rotary part of which is coupled to the distributor member. The outlet pressure of the low pressure pump is controlled in known manner by means of a relief valve 43 so that the outlet pressure of the pump varies in accordance with the speed at which the apparatus is driven. The outlet 41 of the pump is connected by way of an anti-shock valve not shown, with the cylinder which contains the piston 20 so that the timing of fuel delivery varies in accordance with the speed of the associated engine.

Considering now the operation of the pump. The various parts of the pump are shown at the commencement of inward movement of the pumping plungers 16 with the valve 35 in the closed position. As the plungers move inwardly fuel displaced from the bore 15 flows by way of the delivery passage 22 to an outlet 23 and hence to an injection nozzle of the associated engine. When it is deemed that the required quantity of fuel has been supplied to the engine, the valve 35 is opened by deenergising the associated actuator. Fuel can now flow by way of the control valve into the one end of the cylinder to displace the piston 27 against the action of the spring 29. Following the initial displacement fuel can escape from the bores 15 by way of the passage 30 and the fuel flows into the cylinder 28 to effect further movement of the piston against the action of the spring. Fuel will continue to flow into the cylinder until the plungers reach the crests of the cam lobes and during the initial outward movement of the plungers the fuel contained in the cylinder will be returned to the bores 15 by the action of the spring 29. Such movement of the piston will occur until the valve member 26 moves into engagement with the seating. The force developed by the spring 29 results in a fuel pressure which is greater than the outlet pressure of the low pressure pump 42 so that such displacement of fuel into the bore 15 takes place before fuel flows into the bores 15 from the outlet of the low pressure pump. During the final outward movement of the plungers 16 the valve 35 is moved to the closed position. The cycle is then repeated with fuel being supplied to the injection nozzles of the associated engine in turn.

It will be appreciated that under light load conditions with only a small quantity of fuel being supplied to the associated engine, most of the fuel displaced by the plungers 16 flows into the cylinder 28 and is returned to the bores during the next filling stroke. The fuel therefore becomes heated and in turn heats the surrounding structure of the pump. In particular hot fuel in the passage 33, results in heating of the distributor member within the sleeve and this can lead to seizure.

Figure 2:
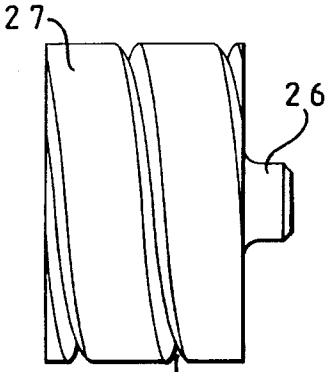
FIG. 2 shows to an enlarged scale and in side elevation, part of the pump which is seen in FIG. 1.

In order to minimise the heating effect it is proposed to allow fuel to escape from the cylinder 28 and this is achieved and as is shown in FIG. 2, by providing on the surface of the piston, a helical or like groove 44. The amount of fuel which flows along the groove 44 ensures that there is sufficient fresh fuel supplied to the bores to prevent an excessive temperature rise. It will be appreciated that the flow of fuel along the groove 44 depends upon the viscosity of the fuel so that the flow increases as the fuel becomes heated and less viscous. It will be appreciated that the flow of fuel occurs only whilst the piston has been displaced against the action of its spring.

If it should prove necessary to further cool the fuel which is contained in the passage 33, the passage 37 may be connected to the outlet 41 of the low pressure pump. Conveniently this can be achieved as shown in the example, by providing a helical or like groove 45 on the periphery of the sleeve 11, the groove effecting communication between the outlet 41 of the pump and a point in the connection between the passage 37 and the circumferential groove 34.

The sizes of the grooves 44 and 45 have to be carefully controlled so that in the case where the groove 44 alone is provided, the pressure pulse which moves along the passage 33 when the control valve 35 is opened, is sufficient to effect the initial movement of the piston 27. In the case where both grooves are provided a similar requirement exists but also the groove 45 must provide sufficient restriction so that the pressure pulse is not lost into the outlet 41 of the low pressure pump. In addition where both grooves are provided the pressure which pertains in the cylinder 28 must not be sufficient to effect movement of the piston 27 against the action of the spring 29. The use of the grooves has the advantage that they contain columns of fuel of substantial length and therefore inertia and the inertia of the fuel in the grooves helps to preserve the pressure pulse when the control valve 35 is opened.

It will be appreciated that the groove 44 could be formed in the wall of the cylinder 28 and the groove 45 in the wall of the body surrounding the sleeve.

I claim:

1. A fuel injection pump for supplying fuel to an internal combustion engine comprising a pumping plunger slidable in a bore, a cam operable to move the pumping plunger inwardly towards one end of the bore, an outlet communicating with said end of the bore and through which fuel is supplied to the associated engine, a spill valve including a spill valve member operable to spill fuel from said end of the bore during inward movement of the pumping plunger thereby to control the quantity of fuel supplied through the outlet, means biasing the valve member to the closed position, a piston slidable in a cylinder and a control valve operable to supply fuel under pressure from said one end of the bore to one end of said cylinder thereby to displace the piston towards the other end of the cylinder, said piston and said spill valve member being operatively connected so that movement of the piston away from said one end of the cylinder will effect movement of the spill valve member from the closed position to spill fuel from said one end of the bore, the piston and the wall of the cylinder defining a restricted flow path whereby fuel can escape from said one end of the cylinder.

2. A pump according to claim 1 in which the restricted flow path is defined by a helical groove formed in one of the cylindrical surfaces of the cylinder and piston.

3. A pump according to claim 1 including a further restricted flow path through which fuel can flow to said one end of the cylinder from a source of fuel at low pressure.

4. A pump according to claim 3 in which the further restricted flow path communicates adjacent the control valve, with a passage which connects the control valve with said one end of the cylinder.

* * * * *